US006374979B1

(12) United States Patent
Kamiya et al.

(10) Patent No.: US 6,374,979 B1
(45) **Date of Patent: *Apr. 23, 2002**

(54) KARAOKE SYSTEM MONEY COUNTING MACHINE AND KARAOKE APPARATUS

(75) Inventors: Shingo Kamiya; Minoru Ogita, both of Hamamatsu (JP)

(73) Assignee: Yamaha Corporation, Hamamatsu (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/103,649

(22) Filed: Jun. 23, 1998

(30) Foreign Application Priority Data

Jun. 24, 1997 (JP) ..... 9-167770

(51) Int. Cl.[7] ..... G07F 17/00

(52) U.S. Cl. ..... 194/217

(58) Field of Search ..... 194/217, 218

(56) References Cited

U.S. PATENT DOCUMENTS 3,360,094 A * 12/1967 Romanowski ..... 194/217
4,369,442 A * 1/1983 Werth et al. ..... 340/825.35
4,872,541 A * 10/1989 Hayashi ..... 194/217
5,409,092 A * 4/1995 Itako et al. ..... 194/217 X

* cited by examiner

*Primary Examiner*—F. J. Bartuska
(74) *Attorney, Agent, or Firm*—Pillsbury Winthrop LLP

(57) ABSTRACT

In an informing mode, a coin box outputs informing pulses, the number of which corresponds to the number of remaining credits, in response to pulses supplied from a service providing apparatus (steps S23 to S26). The service providing apparatus counts the number of informing pulses to detect the number of remaining credits. In an accounting mode, when the coin box detects a pulse output from the service providing apparatus, the coin box decrements the number of remaining credits one by one for every detection of a pulse output from the service providing apparatus (steps S27 to S29). In this way, the accounting is performed by decrementing the number of remaining credits in the coin box by the number of pulses corresponding to the service compensation.

1 Claim, 5 Drawing Sheets

KARAOKE SYSTEM MONEY COUNTING MACHINE AND KARAOKE APPARATUS

BACKGROUND OF THE INVENTION

The present invention relates to a service providing system, a coin counting machine, and a service providing apparatus.

A coin counting machine (hereinafter referred to as a coin box) which is connected to a predetermined service providing apparatus such as a karaoke apparatus and accepts an input of a coin as a compensation for provision of service (hereinafter referred to as a service compensation) is known. A coin box of such a type increments the number of credits in accordance with the amount of input value (usually the number of coins of a specific kind), and performs the accounting by decrementing the number of credits, which was set in the coin box, by a number corresponding to the service compensation in response to a control signal supplied from a service providing apparatus that has completed the provision of the service. In general, the coin box sets a numerical value corresponding to a service compensation, and transmits a signal indicating whether the number of remaining credits is equal to or larger than the set value or not, to the service providing apparatus. The service providing apparatus detects whether the remaining credits satisfy the service compensation or not in accordance with the signal supplied from the coin box (but the service providing apparatus does not know the number of remaining credits). If the remaining credits satisfy the service compensation, the service providing apparatus starts the provision of service. When the provision of service is completed, the service providing apparatus outputs a control signal directing the coin box to decrement the number of remaining credits. In response to the control signal, the coin box decrements the number of remaining credits by a set value corresponding to the service compensation.

As described above, in the prior art, a value corresponding to a service compensation is set in the coin box, and the comparison of the remaining credits with the service compensation is also performed in the coin box. In addition, only the information indicating whether the remaining credits satisfy the service compensation or not is provided to the service providing apparatus. For this reason, it is difficult, for example, to change a service compensation in accordance with various conditions, or to perform settings for a plurality of different service compensations. Thus, there exists a problem in that the prior art lacks the flexibility.

SUMMARY OF THE INVENTION

The present invention has been made in view of the above-described background. It is an object of the invention to provide a service providing system, a coin counting machine, and a service providing apparatus which has excellent flexibility in setting service compensations.

In order to solve the above-mentioned problems, the invention of a first aspect is a service providing system comprising: a coin counting machine which accepts an input of a coin; and a service providing apparatus which provides a predetermined service in accordance with the input of a coin, wherein the coin counting machine comprises:

counting means for incrementing the number of credits in a predetermined unit in accordance with an input of a coin, and for decrementing the number of credits in response to a control signal supplied from the service providing apparatus; and informing means for informing the service providing apparatus of the number of remaining credits in the counting means, and the service providing apparatus comprises:

setting means for setting a value corresponding to a compensation of a service to be provided;

service providing means for providing the service on condition that the number of remaining credits informed by the informing means is equal to or larger than the value set by the setting means; and accounting means for outputting a control signal which directs that the number of remaining credits in the coin counting machine be decremented by a number corresponding to the value set by the setting means, as an account for the service.

The invention of a second aspect is a system in which the service providing system of the first aspect is configured so that the service providing apparatus comprises a host computer, and a service providing terminal which is connected to the host computer via a communication line, and the service providing terminal provides the service and sets the compensation based on data distribution from the host computer.

The invention of a third aspect is a coin counting machine which is to be applied to the service providing system of the first or second aspect, and which comprises:

counting means for incrementing the number of credits in a predetermined unit in accordance with an input of a coin, and for decrementing the number of credits in response to the control signal supplied from the service providing apparatus; and informing means for informing the service providing apparatus of the number of remaining credits in the counting means.

The invention of a fourth aspect is a service providing apparatus which is to be applied to the service providing system of the first or second aspect, and which comprises:

setting means for setting a value corresponding to a compensation of a service to be provided;

service providing means for providing the service on condition that the number of remaining credits informed by the informing means is equal to or larger than the value set by the setting means; and accounting means for outputting a control signal which directs that the number of remaining credits in the coin counting machine be decremented by a number corresponding to the value set by the setting means as an account for the service.

DESCRIPTION OF THE INVENTION

Preferred embodiments of the present invention will now be described with reference to the drawings.

A: Configuration of an Embodiment

Figure 1:
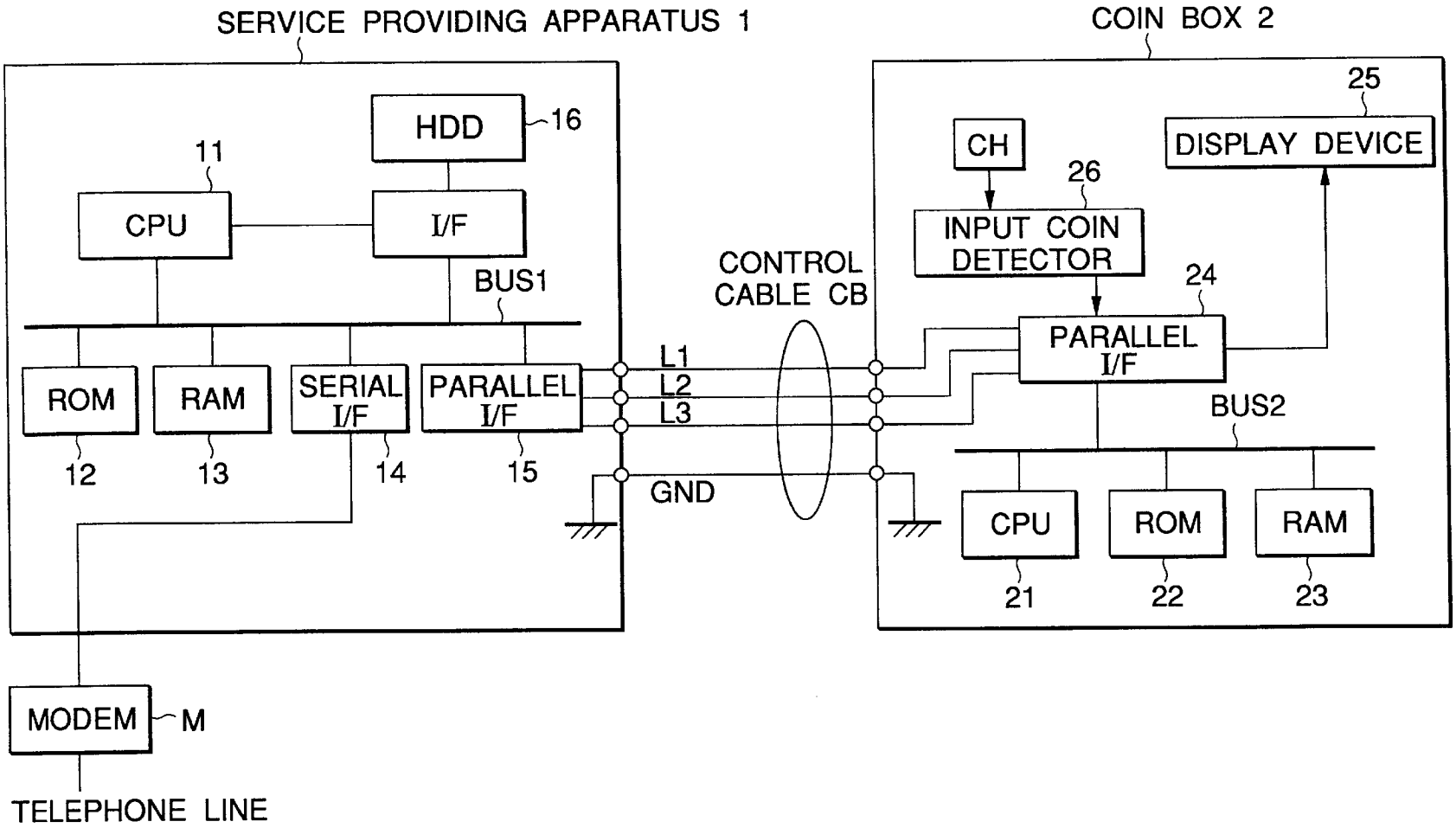
FIG. 1 is a block diagram showing the configuration of a service providing system of an embodiment of the invention.

FIG. 1 is a block diagram showing the configuration of a service providing system according to an embodiment of the invention. In the figure, reference numeral 1 designates a service providing apparatus which provides a predetermined service, and 2 designates a coin box which accepts an input of a coin.

The service providing apparatus 1 comprises a CPU 11 which controls various portions of the apparatus connected via a bus BUS1, a ROM 12 which stores a control program to be executed by the CPU 11, a RAM 13 which is used as a working area of the CPU 11, a serial I/F (interface) 14 connected to a telephone line via a modem M, a parallel I/F 15 connected to the coin box 2 via a control cable CB, and a hard disk apparatus 16 which stores various data and programs required for providing the service (including data distributed via the modem M). The service providing apparatus 1 has a user interface which is not shown. A service request by an operator and a set value which is to be set in the RAM 13 in accordance with a service, are input through the user interface. The set value is input by, for example, using a password in order to allow only a specified person such as a system administrator to input the set numeric value. Alternatively, the set value is rewritten in accordance with the setting of the service program read from the hard disk apparatus 16.

The coin box 2 comprises a CPU 21 which controls various portions of the apparatus connected via a bus BUS2, a ROM 22 which stores a control program to be executed by the CPU 21, a RAM 23 used as a working area of the CPU 21, a parallel I/F 24 connected to the service providing apparatus 1 via the control cable CB, a display device 25 consisting of LEDs (Light Emitting Diodes) or the like which displays the number of remaining credits counted by the CPU 21, and an input coin detector 26 which detects a coin input through a coin slot CH.

The control cable CB includes three control signal lines L1 to L3, and a ground line GND.

B: Operation of the Embodiment

Figure 2:
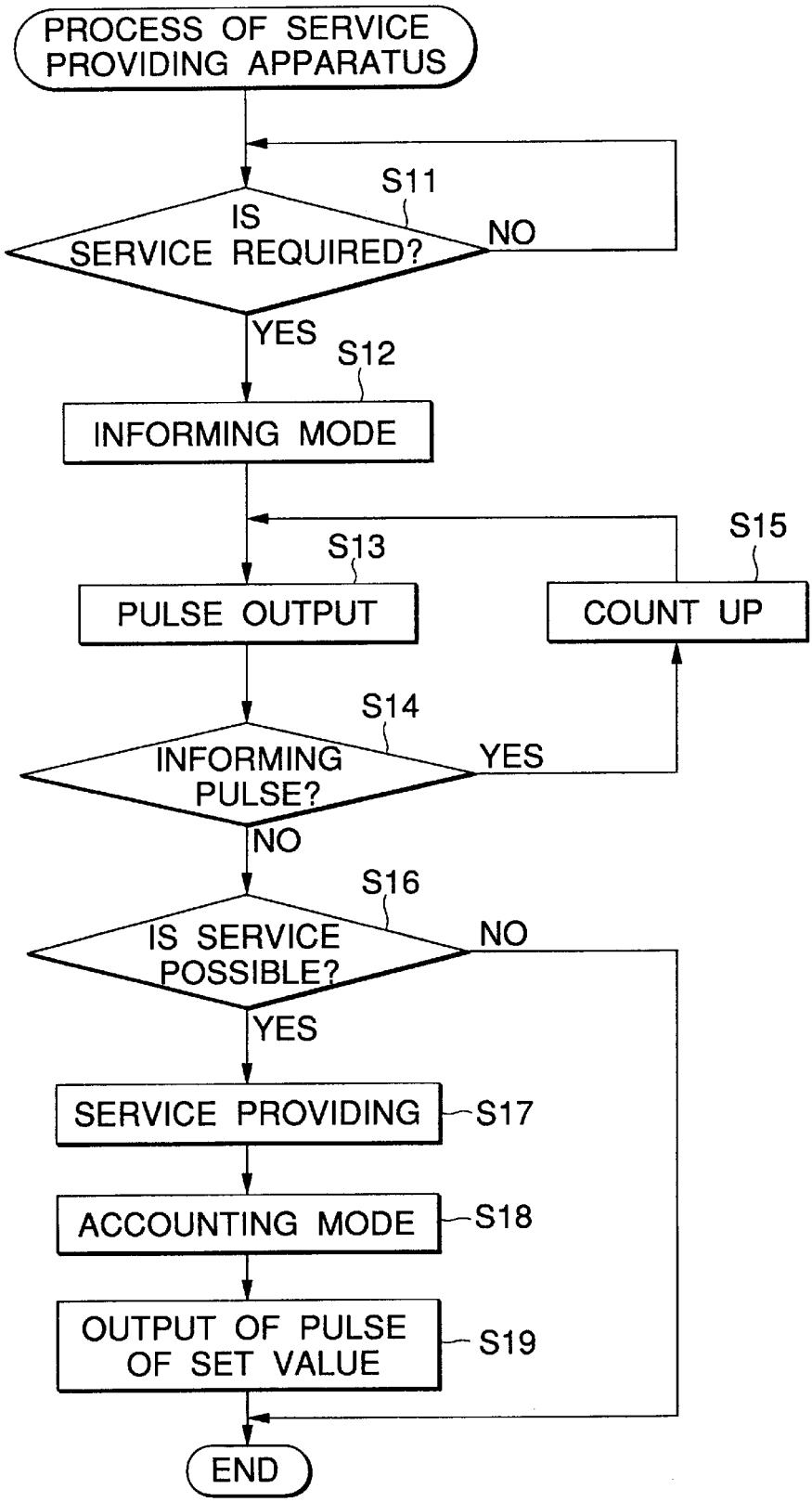
FIG. 2 is a flowchart showing a control program executed by a CPU of a service providing apparatus.
Figure 3:
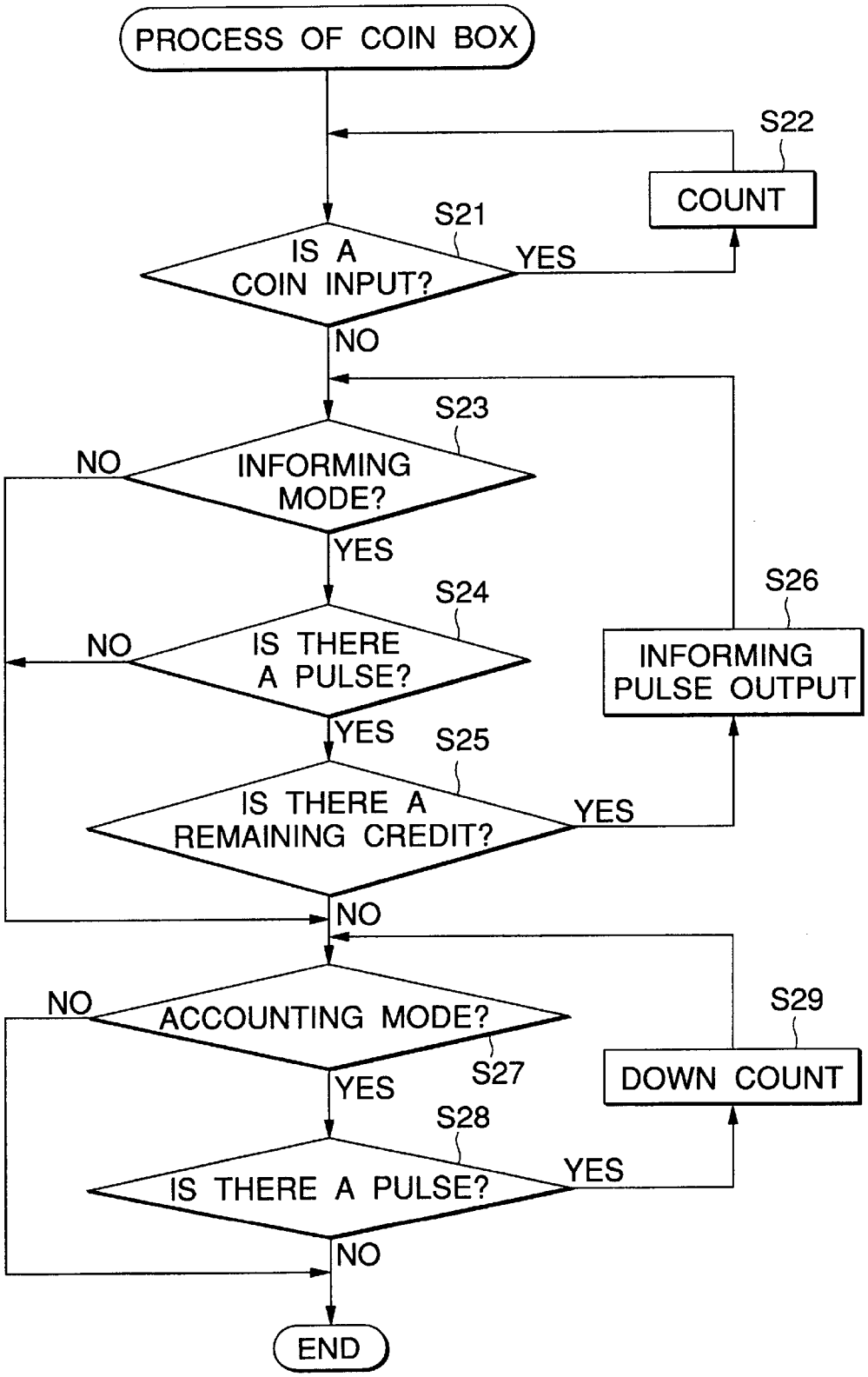
FIG. 3 is a flowchart showing a control program executed by a CPU of a coin box.
Figure 4:
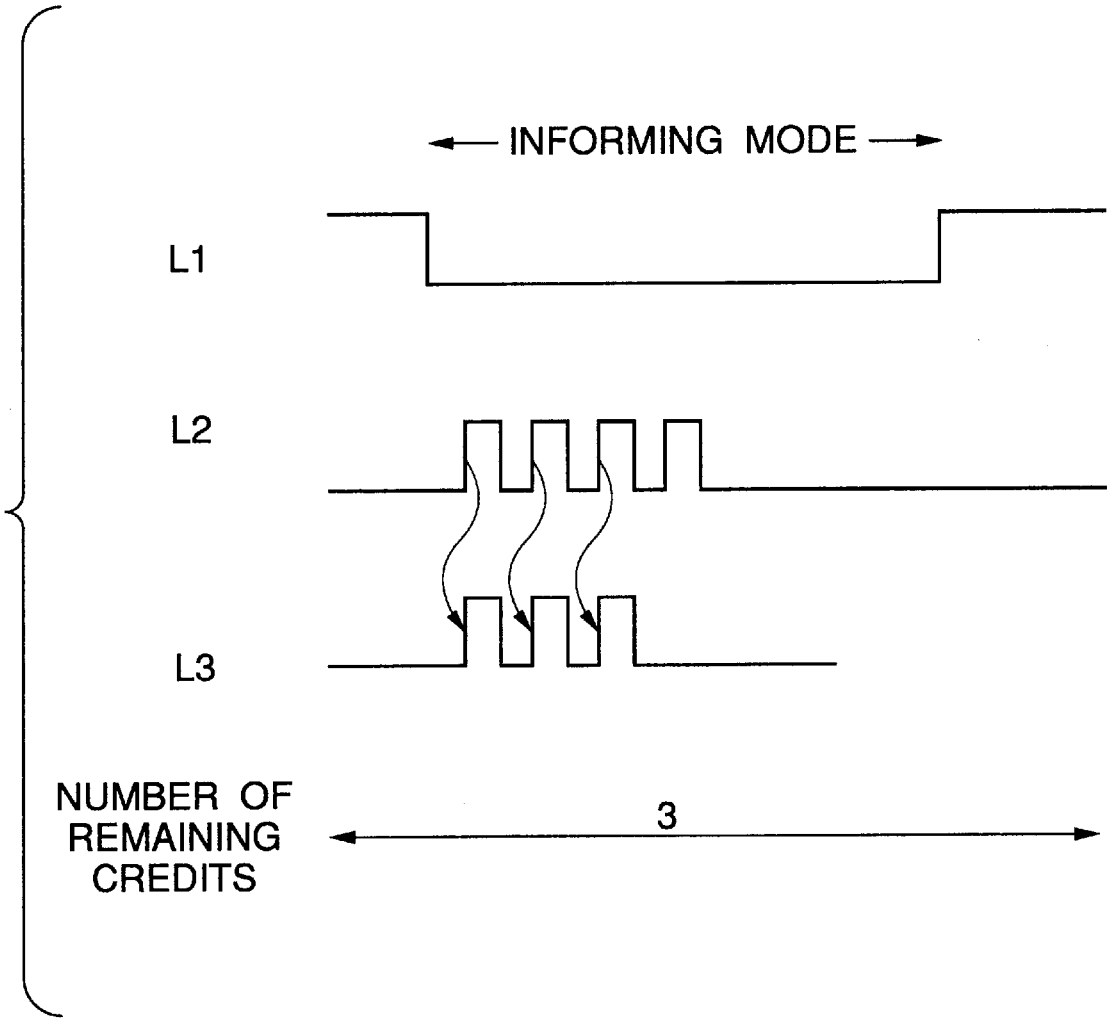
FIG. 4 is a timing chart showing exchanges of signals between the coin box and the service providing apparatus in an informing mode.
Figure 5:
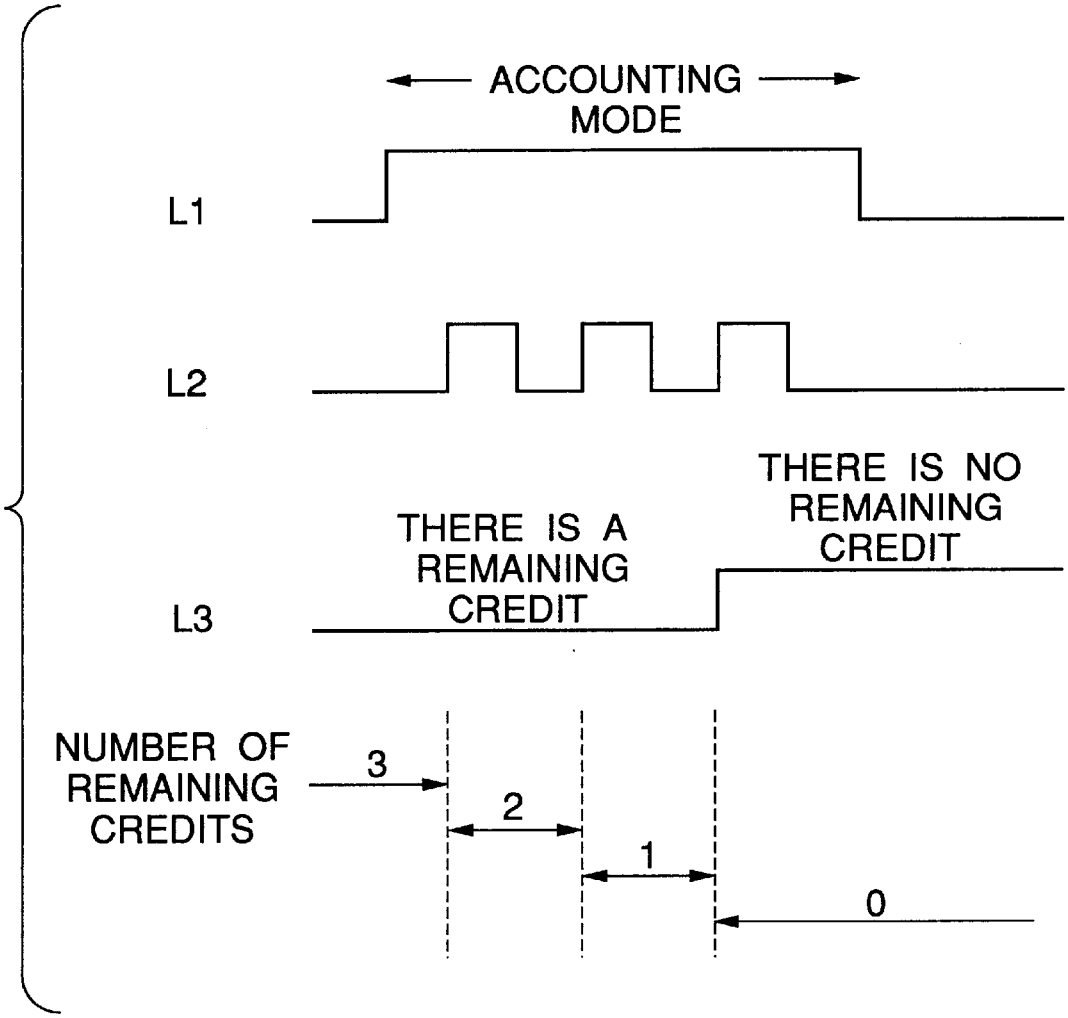
FIG. 5 is a timing chart showing exchanges of signals between the coin box and the service providing apparatus in an accounting mode.

FIG. 2 is a flowchart showing the control program executed by the CPU 11 of the service providing apparatus 1. FIG. 3 is a flowchart showing the control program executed by the CPU 21 of the coin box 2. FIG. 4 is a timing chart showing exchanges of signals between the service providing apparatus 1 and the coin box 2 in an informing mode, and FIG. 5 is a timing chart showing exchanges of signals between the service providing apparatus 1 and the coin box 2 in an accounting mode. The informing mode is a mode in which the coin box 2 informs the service providing apparatus 1 of the number of remaining credits. The accounting mode is a mode in which the accounting is performed by decrementing the number of remaining credits in the coin box 2 by a number corresponding to the service compensation.

Hereinafter referring to FIGS. 2 to 5, the operation of the service providing system will be described in the order of an initial operation, an operation in the informing mode, provision of service, and an operation in the accounting mode.

(1) Initial Operation

When a power of the service providing apparatus 1 is turned on, the CPU 11 loads the control program shown in FIG. 2 from the ROM 12 and starts the control program. As a result, the service providing apparatus 1 enters a waiting state for a service request from an operator (step S11). When a power of the coin box 2 is turned on, the CPU 21 loads the control program shown in FIG. 3 from the ROM 22 and starts the control program. As a result, the coin box 2 can accept an input of a coin by the operator. When a coin is put into the coin box 2 (step S21), the coin box 2 increments the number of remaining credits set in the RAM 23 (step S22).

When the operator directs the service providing apparatus 1 to render a service by using the user interface, which is not shown, the CPU 11 of the service providing apparatus 1 sets the operation mode to be the informing mode in the manner described below, and is informed of the number of remaining credits from the coin box 2.

(2) Operation in the Informing Mode

First, the service providing apparatus 1 sets the signal level of the control signal line L1 to be Low, so as to set the operation mode to be the informing mode (step S12). In the informing mode, the service providing apparatus 1 outputs a pulse to the control signal line L2 (step S13). When the coin box 2 detects the pulse output to the control signal line L2 in the informing mode, the coin box 2 outputs, in response to the pulse, an informing pulse for informing the number of remaining credits to the control signal line L3 (steps S23 to S26). When the service providing apparatus 1 receives the informing pulse from the coin box 2, the service providing apparatus 1 performs the incrementing operation in accordance with the informing pulse, and outputs a pulse to the control signal line L2 in response to the informing pulse (steps S13 to S15). In response to the pulse supplied again from the service providing apparatus 1, the coin box 2 outputs an informing pulse (step S26). In this way, the coin box 2 outputs informing pulses, the number of which corresponds to the number of remaining credits, in response to the pulses supplied from the service providing apparatus 1, and the service providing apparatus 1 counts the number of the informing pulses. When no more informing pulse is supplied from the coin box 2, the service providing apparatus 1 stops outputting a pulse to the control signal line L2, and terminates the count operation. The timing chart shown in FIG. 4 illustrates an example in which the number of remaining credits "3" is informed.

(3) Provision of Service

Next, the service providing apparatus 1 compares the informed number of remaining credits with a value which is previously set in the RAM 13 in correspondence with the service compensation (i.e., the set value), and judges whether the remaining credits satisfy the service compensation or not (step S16). If the remaining credits satisfy the service compensation, a predetermined service is provided (step S17). In a karaoke apparatus, for example, the service provided in this operation includes a performance of a music piece, scoring which is selectively performed, or the like. The kind of the provided service is not limited, and various kinds of services may be adopted.

If the number of the remaining credits is smaller than the service compensation, the program is terminated without providing the service.

(4) Operation in the Accounting Mode

When provision of service is finished, the service providing apparatus 1 sets the signal level of the control signal line L1 to be High, so as to set the mode to be the accounting mode (step S18). In the accounting mode, the service providing apparatus 1 outputs pulses, the number of which corresponds to the set value for the service compensation, to the control signal line L2 (step S19). When the coin box 2 detects the pulses output to the control signal line L2 in the accounting mode, the coin box 2 decrements the number of remaining credits one by one for every detection of a pulse (steps S27 to S29). In this way, the accounting is performed by decrementing the number of remaining credits in the coin box 2 by a number corresponding to the service compensation. The timing chart shown in FIG. 5 illustrates an example in which the set value for the service compensation is "3."

As shown in FIG. 5, when the number of remaining credits becomes "0," the coin box 2 changes the signal level of the control signal line L3 from Low to High. In other words, when there exist remaining credits, the signal level of the control signal line L3 is Low, and, when there is no remaining credit, the signal level of the control signal line L3 is High. Accordingly, the service providing apparatus 1 can detect whether there exist remaining credits or not. C: Modifications The invention is not limited to the above-described embodiment and can be variously modified as follows.

(1) For example, the service providing apparatus 1 may be configured in such a manner that the apparatus selectively provides a specified one of a plurality of services having different compensations. In this case, different values are previously set for the plurality of services with different compensations, respectively, in the RAM 13 (or a value is set in accordance with the provided service), and the specified service is provided on condition that the number of remaining credits informed from the coin box 2 is equal to or larger than the value corresponding to the specified service. In the accounting, the service providing apparatus 1 outputs pulses to the coin box 2 so that the number of remaining credits is decremented by a number corresponding to the value for the specified service.

(2) The coin box 2 may be configured so that, in the same manner as a coin box of the prior art, the coin box 2 additionally comprises means for setting a value corresponding to a service compensation, for comparing the set value with the number of remaining credits, and for informing whether the remaining credits satisfy the service compensation or not. This configuration has compatibility with a service providing apparatus of the prior art.

(3) In the embodiment, provision of service and the accounting are performed as a combination in such a manner that the accounting is always performed for each provision of service. The invention is not limited to the embodiment. The apparatus may be configured so that provision of service is performed separately from the accounting and, even if a service is provided, for example, the accounting is performed only when a predetermined condition is satisfied. According to this configuration, in the case where the invention is applied to a performance service of a karaoke apparatus, for example, it is possible to realize a function that, when the score result of a singer exceeds a predetermined score, the accounting is not performed as a privilege.

(4) The setting of a value for a service compensation may not be performed via the user interface. In a system having such a configuration that plural service providing apparatuses 1 are connected to a center host computer via a telephone line or the like, for example, data for changing a value corresponding to a service compensation are distributed from the host computer to the respective service providing apparatuses 1, so as to collectively change the numeric value.

(5) In the embodiment, the coin box 2 designed for only coins is exemplarily described. The invention may be applied also to various types of coin counting machines which accept an input of paper money in addition to the input of coins.

(6) The service providing apparatus 1 may be configured as a communication system in which a host computer and service providing terminals are connected via a communication line so that, based on the data distribution from the host computer, provision of service and setting of the service compensation are performed in the service providing terminals.

As described above, according to the invention, a service providing system with excellent flexibility in setting service compensations can be realized.

What is claimed is:

1. A karaoke system comprising:

a money counting machine which accepts an input of money;

a karaoke apparatus which provides a performance service in accordance with the input of money, said karaoke apparatus being connected to said money counting machine via a control cable having a plurality of control signal lines, wherein said money counting machine includes:

a counting device which increments a number of credits in a unit in accordance with the input of money, and decrements the number of credits in response to a control signal supplied from said karaoke apparatus via said control cable, and an informing device which informs said karaoke apparatus of a number of remaining credits in said counting device via said control cable, and wherein said karaoke apparatus includes:

a setting device which sets a value according to a compensation of the performance service to be provided by the karaoke apparatus, a karaoke performance provider which provides the performance service on condition that the number of remaining credits informed by said informing device is equal to or larger than the value set by said setting device, and an accounting device which outputs to said control cable the control signal which directs that the number of credits in said money counting machine be decremented by a number corresponding to the value set by the setting device, as an account for the performance service; and wherein a signal indicative of an operation mode of the karaoke apparatus and the money counting machine is transmitted via one of the plurality of control signal lines, the operation mode being one of an informing mode and an accounting mode, wherein in the informing mode, the number of remaining credits is informed to the karaoke apparatus from the money counting machine, and wherein the accounting mode, an account is conducted by decrementing the number of credits in the money counting machine by the number corresponding to the value set by said setting device.

* * * * *